US010041011B2

(12) United States Patent
Govindhakannan et al.

(10) Patent No.: US 10,041,011 B2
(45) **Date of Patent: *Aug. 7, 2018**

(54) PROCESSES FOR RECOVERING HYDROCARBONS FROM A DRAG STREAM FROM A SLURRY HYDROCRACKER

(71) Applicant: UOP LLC, Des Plaines, IL (US)

(72) Inventors: Jagannathan Govindhakannan, Des Plaines, IL (US); Robert Haizmann, Rolling Meadows, IL (US); Trung Pham, Mount Prospect, IL (US); Hans G. Lefebvre, Chicago, IL (US)

(73) Assignee: UOP LLC, Des Plaines, IL (US)

( * ) Notice: Subject to any disclaimer, the term of this patent is extended or adjusted under 35 U.S.C. 154(b) by 206 days.

This patent is subject to a terminal disclaimer.

(21) Appl. No.: 14/534,664

(22) Filed: Nov. 6, 2014

(65) Prior Publication Data

US 2016/0130511 A1 May 12, 2016

(51) Int. Cl.

| | |
|---|---|
| ***C10G 47/26*** | (2006.01) |
| ***C10G 53/02*** | (2006.01) |
| ***C10G 67/02*** | (2006.01) |
| ***C10G 67/04*** | (2006.01) |
| ***C10G 53/04*** | (2006.01) |
| ***C10G 1/02*** | (2006.01) |
| ***C10G 1/04*** | (2006.01) |

(52) U.S. Cl.

CPC ..... *C10G 53/02* (2013.01); *C10G 1/02* (2013.01); *C10G 1/04* (2013.01); *C10G 53/04* (2013.01); *C10G 67/02* (2013.01); *C10G 67/04* (2013.01); *C10G 47/26* (2013.01); *C10G 2400/06* (2013.01); *C10G 2400/16* (2013.01)

(58) Field of Classification Search

CPC ..... C10G 47/26; C10G 47/36

See application file for complete search history.

(56) References Cited

U.S. PATENT DOCUMENTS

| | | | | |
|---|---|---|---|---|
| 6,361,591 | B1 | 3/2002 | Boyer et al. | |
| 8,133,446 | B2 | 3/2012 | McGehee et al. | |
| 8,193,401 | B2 | 6/2012 | McGehee et al. | |
| 8,202,480 | B2 | 6/2012 | McGehee et al. | |
| 9,777,226 | B2 * | 10/2017 | Pham | C10G 47/26 |
| 2007/0158239 | A1 * | 7/2007 | Satchell | C10G 65/10 208/113 |
| 2009/0163348 | A1 * | 6/2009 | Da Costa | B01D 61/142 502/22 |
| 2010/0122932 | A1 * | 5/2010 | Haizmann | C10G 47/26 208/55 |
| 2010/0122934 | A1 | 5/2010 | Haizmann et al. | |
| 2010/0122939 | A1 * | 5/2010 | Bauer | C10G 67/02 208/425 |

(Continued)

*Primary Examiner* — Michelle Stein

(57) ABSTRACT

A process for recovering hydrocarbons from a slurry hydrocracking reactor. The hydrocarbons are recovered by taking a drag stream of the slurry in the reactor. After separating lighter hydrocarbons in a separation zone, the heavier hydrocarbons can be processed in a deashing zone, with a vacuum column bottoms from a separation of the effluent stream recovered from the reactor. The deashing zone can recover the heavier hydrocarbons in a deashed pitch. Additionally, a VGO rich stream from the deashing zone may be recycled back to the reactor.

19 Claims, 1 Drawing Sheet

(56) References Cited

U.S. PATENT DOCUMENTS

2010/0243518 A1* 9/2010 Zimmerman ..... C10G 67/049
208/45
2011/0303580 A1* 12/2011 Haizmann ..... C10G 47/26
208/40

* cited by examiner

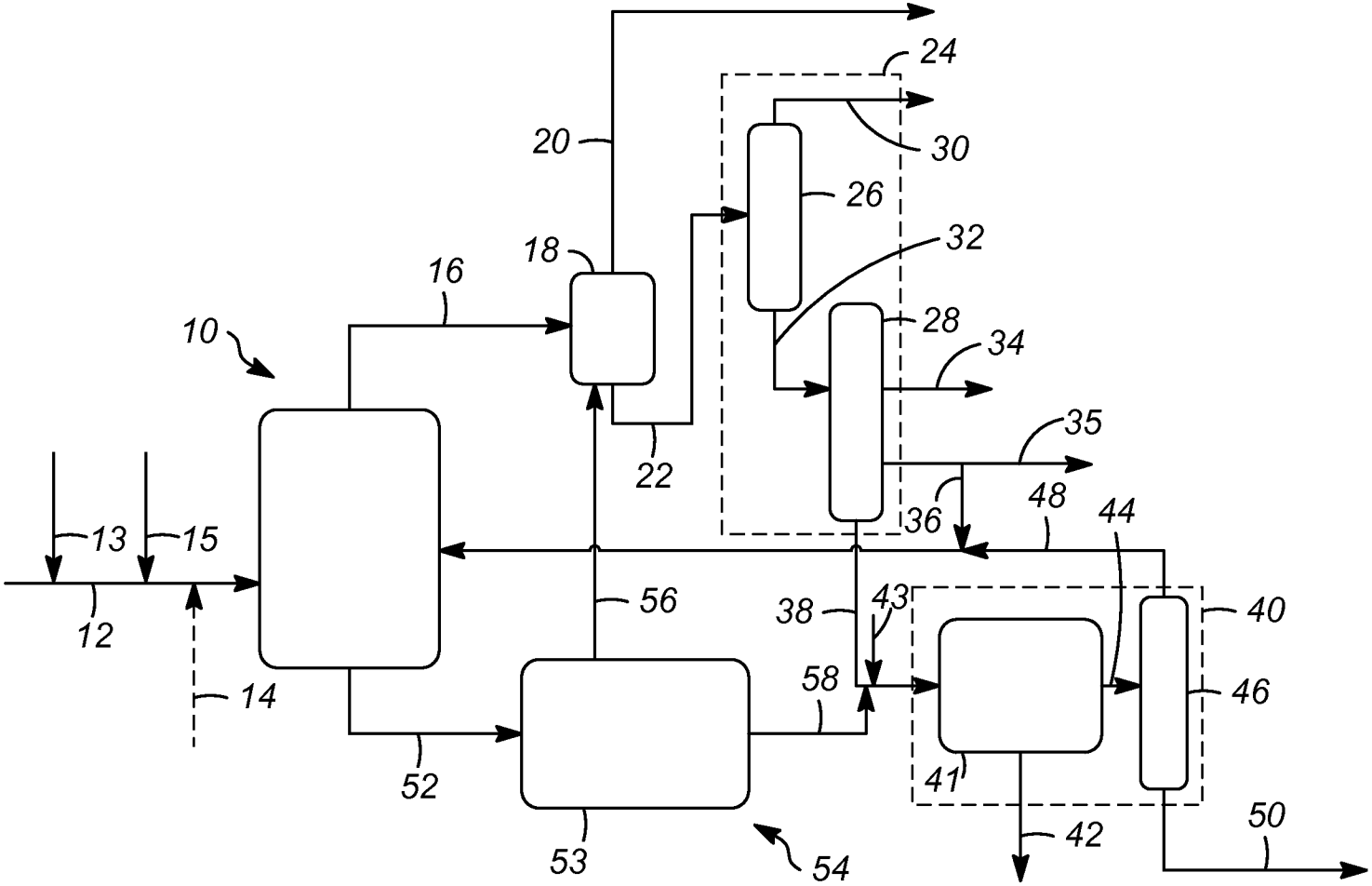
10
12
13
14
15
16
18
20
22
24
26
28
30
32
34
35
36
38
40
41
42
43
44
46
48
50
52
53
54
56
58

PROCESSES FOR RECOVERING HYDROCARBONS FROM A DRAG STREAM FROM A SLURRY HYDROCRACKER

FIELD OF THE INVENTION

This invention relates generally to processes for recovering hydrocarbons from a slurry hydrocracking reactor, and more particularly to increasing the yield of recovery from the slurry hydrocracking reactor, as well as increasing the overall conversion with less bypass from dragging.

BACKGROUND OF THE INVENTION

Dispersed catalysts are employed in slurry bed hydrocracking processes for converting heavy residues to transportation-fuel range fractions. Slurry hydrocracking is used for the primary upgrading of heavy hydrocarbon feed stocks obtained from the distillation of crude oil, including hydrocarbon residues or gas oils from atmospheric or vacuum distillation. In slurry hydrocracking, these liquid feed stocks are mixed with hydrogen and solid catalyst particles, e. g., as a particulate metallic compound such as a metal sulfide, to provide a slurry phase. Representative slurry hydrocracking reactors and processes are described, for example, in U.S. Pat. No. 5,755,955 and U.S. Pat. No. 5,474,977. Slurry hydrocracking produces naphtha, diesel, gas oil such as light VGO (LVGO) and heavy VGO (HVGO), and a low-value, refractory pitch stream. The VGO streams are typically further refined in catalytic hydrocracking or fluid catalytic cracking (FCC) to provide saleable products. To prevent and/or reduce the formation of coke precursors, the HVGO stream can be recycled to the slurry hydrocracking reactor.

If the level of solids in the slurry reactor exceeds certain levels, the solids will begin to collect at the bottom of the slurry reactor. This can lead to coking of the solids, plugging, reactor fouling, temperature anomalies, and other such issues. Additionally, removing the accumulated solids will require an undesirable shutdown of the slurry reactor. In order to control the accumulation of solids in the slurry reactor, a common practice is to periodically withdraw a drag stream from the bottom of the reactor. However, while removing a drag stream from the bottom of the reactor, the unconverted feed and product hydrocarbon might bypass and leave in the drag stream. The loss of the uncovered feed and the product hydrocarbon material is undesirable In addition to unconverted feed and product materials, the drag stream contains organic and inorganic solids. The storage and disposal and of this stream could become a potential problem for the refiner.

The prior art regarding the strategies for the disposal of the drag stream might involve storing this stream in a slop tank and burning it as a fuel in cement kilns. If dissolved gases, and naphtha and distillate range hydrocarbons are removed, the drag stream may contain about 30 wt % VGO, 50 wt % material with an initial boiling point above 524° C. (975° F.), and 20 wt % solids.

Therefore, there remains a need for an effective and efficient process for recovering the hydrocarbons from a drag stream from a slurry hydrocracking unit.

SUMMARY OF THE INVENTION

One or more processes for recovering hydrocarbons from a drag stream from a slurry hydrocracking reactor have been invented.

In a first aspect of the present invention, the invention may be characterized as a process for recovering hydrocarbons from a hydrocracking zone by: cracking a feed stock in a hydrocracking zone to produce a converted hydrocarbon stream, the hydrocracking zone comprising a slurry hydrocracker; removing a drag stream from the hydrocracking zone, the drag stream comprising a mixture of catalyst, coke, converted hydrocarbons, and unconverted hydrocarbons separating the drag stream into a vapor portion and a liquid portion, the vapor portion of the drag stream comprising converted hydrocarbons; and, separating HVGO from the liquid portion of the drag stream.

In some embodiments of the present invention, the process also includes combining the vapor portion of the drag stream with the converted hydrocarbon stream to form a combined hydrocarbon stream. It is contemplated that the vapor portion of the drag stream and the converted hydrocarbon stream are combined in a separation zone. In such embodiments, the process may further include separating the combined hydrocarbon stream into a $C_4$− hydrocarbon stream and a $C_5$+ hydrocarbon stream. It is even further contemplated that the process also include separating the $C_5$+ hydrocarbon stream into a transportation fuel stream and a residue stream. It is still further contemplated that the process includes passing the residue stream to a vacuum separation zone comprising at least one vacuum column, and separating the residue stream into an LVGO stream, an HVGO stream and a pitch stream. It is also further contemplated that the process includes passing a portion of the HVGO stream from the vacuum separation zone to the hydrocracking zone, and passing the HVGO stream separated from the liquid portion of the drag stream to the hydrocracking zone. It is still further contemplated that the process includes combining the portion of the HVGO stream from the vacuum separation zone and the HVGO stream separated from the liquid portion of the drag stream for form a combined HVGO stream, and passing the combined HVGO stream to the hydrocracking zone.

In one or more embodiments of the present invention, the process includes separating the liquid portion of the drag stream in a deashing zone into a dried solids, a deashed pitch, and the HVGO stream. It is contemplated that the deashing zone comprises a solvent separation zone and the dried solids comprises an insoluble portion of the liquid portion of the drag stream. It is also contemplated that the process further includes passing a pitch from a bottoms stream of a vacuum column to the deashing zone. It is further contemplated that the pitch comprises a portion of the converted hydrocarbon stream from the hydrocracking zone.

In a second aspect of the present invention, the invention may be characterized as a process for recovering hydrocarbons from a hydrocracking zone, the process comprising: passing a drag stream from a slurry hydrocracker in a hydrocracking zone to a first separation zone, the drag stream comprising a mixture of catalyst, coke, converted hydrocarbons, and unconverted hydrocarbons; separating the drag stream in the first separation zone into a vapor portion and a liquid portion, the vapor portion of the slurry stream comprising unconverted hydrocarbons; and, separating the liquid portion of the drag stream in a second separation zone into an HVGO stream and a pitch stream.

In at least one embodiment of the present invention, the pitch stream comprises a deashed pitch stream. It is contemplated that the process also includes removing solids from the liquid portion of the drag stream in the second separation zone.

In some embodiments of the present invention, the first separation zone includes a high pressure stage and a low pressure stage.

In various embodiments of the present invention, the process also includes passing the vapor portion of the drag stream to a high pressure separation zone. It is contemplated that the process may also include separating the vapor portion of the drag stream in the high pressure separation zone into a $C_4$− hydrocarbon stream and a $C_5$+ hydrocarbon stream. It is also contemplated that the process includes separating the $C_5$+ hydrocarbon stream into a transportation fuel stream and a residue stream. It is further contemplated that the process includes passing the residue stream to a vacuum separation zone comprising at least one vacuum column, and separating the residue stream into an LVGO stream, an HVGO stream and a pitch stream. It is contemplated that the process also includes passing the pitch stream to the second separation zone. It is contemplated that the process further combining the HVGO stream from the at least one vacuum column and the second separation zone to form a combined HVGO stream, and passing the combined HVGO to the hydrocracking zone.

In a third aspect of the present invention, the invention provides a process for recovering hydrocarbons from a hydrocracking zone by: separating a drag stream from a slurry hydrocracker in a first separation zone into a vapor portion and a liquid portion, the drag stream comprising a mixture of catalyst, coke, converted hydrocarbons, and unconverted hydrocarbons, and wherein at least a portion of the vapor portion of the drag stream comprises unconverted hydrocarbons; separating the vapor portion of the drag stream into a $C_4$− hydrocarbon stream and a $C_5$+ hydrocarbon stream; recycling a portion of the $C_5$+ hydrocarbon stream back to the slurry hydrocracker; deashing the liquid portion of the drag stream in a deashing zone to provide a dried solids, a deashed pitch and an HVGO stream; and, recycling the HVGO stream back to the slurry hydrocracker.

Additional objects, embodiments, and details of the invention are set forth in the following detailed description of the invention.

DETAILED DESCRIPTION OF THE DRAWINGS

The drawing is a simplified process diagram in which the FIGURE shows a process according to one or more embodiments of the present invention.

DETAILED DESCRIPTION OF THE INVENTION

As mentioned above, processes have been developed to recover hydrocarbons from a slurry hydrocracking reactor. In one or more embodiments of the present invention, a drag stream from a slurry hydrocracking reactor will be mixed with a pitch stream from a vacuum column associated with processing and separating the effluent stream from the slurry hydrocracking reactor. The mixture may be processed in the pitch deashing unit. The solid particles present in the pitch as well as in the drag stream will be removed and the resulting hydrocarbon material can be used for value-added applications such as asphalt blending and anode manufacturing. The recovered VGO from both the drag and pitch streams can be recycled back to the slurry hydrocracking reactor.

With reference to the attached drawing, one or more embodiments of the present invention will be described with the understanding that the following description is merely exemplary of the present application and is not intended to be limiting.

As shown in the FIGURE, the present invention for recovering hydrocarbons is exemplified by a slurry hydrocracking reactor 10.

A feed stream 12 is passed as feed to the slurry hydrocracking reactor 10 as shown in the FIGURE. A heavy product recycle 14 may be mixed with the heavy feed stream 12 (discussed in more detail below). A coke-inhibiting additive or catalyst of particulate material 13 may be mixed together with the feed stream 12 to form a slurry mixture.

A variety of solid catalyst particles can be used as the particulate material. Particularly useful catalyst particles are those described in U.S. Pat. No. 4,963,247. Thus, the particles are typically ferrous sulfate having particle sizes less than 45 μm and with a major portion, i.e. at least 50% by weight, in an aspect, having particle sizes of less than 10 μm. Iron sulfate monohydrate is a preferred catalyst. Bauxite catalyst may also be preferred. In an aspect, 0.01 to 4.0 wt-% of coke-inhibiting catalyst particles based on fresh feedstock are added to the feed mixture. Oil soluble coke-inhibiting additives may be used alternatively or additionally. Oil soluble additives include metal naphthenate or metal octanoate, in the range of 50 to 1000 wppm based on fresh feedstock with molybdenum, tungsten, ruthenium, nickel, cobalt or iron. The foregoing are merely exemplary of the catalyst typically used in the slurry hydrocracking reactor 10.

This slurry of catalyst and heavy hydrocarbon feed 12 may be mixed with hydrogen 15. The feed stream may be heated in a heater (not shown) before being passed to the slurry hydrocracking reactor 10, preferably towards the bottom of the slurry hydrocracking reactor 10. The slurry hydrocracking reactor 10 may take the form of a three-phase, e.g., solid-liquid-gas, reactor without a stationary solid bed through which catalyst, hydrogen and oil feed are moving in a net upward motion with some degree of back mixing. Many other mixing and pumping arrangements may be suitable to deliver the feed, hydrogen and catalyst to the slurry hydrocracking reactor 10.

In the slurry hydrocracking reactor 10, the heavy feed and hydrogen react in the presence of the catalyst to produce slurry hydrocracked products. The slurry hydrocracking reactor 10 can be operated at quite moderate pressure, in the range of 3.5 to 35 MPa, preferably 13.0 to 27 MPa. The reactor temperature is typically in the range of about 350 to about 600° C. with a temperature of about 400 to about 500° C. being preferred. The LHSV is typically below about 4 $h^{-1}$ on a fresh feed basis, with a range of about 0.05 to about 3 $hr^{-1}$ being preferred and a range of about 0.2 to about 1 $hr^{-1}$ being particularly preferred. A pitch conversion may be at least about 80 wt-%, suitably at least about 85 wt-% and preferably at least about 90 wt-%. The hydrogen feed rate is about 674 to about 3370 $Nm^3/m^3$ (4000 to about 20,000 SCF/bbl) oil. Slurry hydrocracking is particularly well suited to a tubular reactor through which feed and gas move upwardly. Hence, the outlet from slurry hydrocracking reactor 10 is typically above the inlet. Although only one is shown in the FIGURE, one or more slurry hydrocracking reactors 10 may be utilized in parallel or in series. Because of the elevated gas velocities, foaming may occur in the slurry hydrocracking reactor 10. An antifoaming agent may also be added to the slurry hydrocracking reactor 10 to reduce the tendency to generate foam. Suitable antifoaming agents include silicones as disclosed in U.S. Pat. No. 4,969,988. Additionally, a quench medium, for example, hydrogen may be injected into the top of the slurry hydrocracking reactor 10 to cool the slurry hydrocracked product as it is leaving the slurry hydrocracking reactor 10.

A slurry hydrocracked effluent stream 16 comprising a gas-liquid mixture is withdrawn from the top of the slurry hydrocracking reactor 10. The slurry hydrocracked effluent stream 16 comprises several products including VGO and pitch that can be separated in a number of different ways. For example, the slurry hydrocracked effluent stream 16 from the slurry hydrocracking reactor 10 may be separated in a high-pressure separator 18 kept at a temperature in the range of 350 to 450° C., preferably in the range of 375 to 425° C. and pressure in the range of 3.5 to 35 MPa, preferably 13.0 to 27 MPa, or slightly below the pressure of the reactor. The high pressure separator 18 is in downstream communication with the slurry hydrocracking reactor 10.

In the high pressure separator 18, the slurry hydrocracked effluent stream 16 from the slurry hydrocracking reactor 10 is separated into a gaseous stream 20 comprising hydrogen, hydrogen sulfide, and ammonia with vaporized products and a liquid stream 22 comprising liquid slurry hydrocracked products. The gaseous stream 20 is the flash vaporization product at the temperature and pressure of the high pressure separator 18. Likewise, the liquid stream 22 is the flash liquid at the temperature and pressure of the high pressure separator 18. In a preferred embodiment the gaseous stream comprises a $C_4$− hydrocarbon stream and also includes hydrogen, hydrogen sulfide, and ammonia. Accordingly, the liquid stream comprises a $C_5$+ hydrocarbon stream. These are merely exemplary and, as will be appreciated by one of ordinary skill in the art, the compositions of the gaseous stream 20 and the liquid stream 22 from the high pressure separator 18 can be adjusted based upon the operating conditions of same. The gaseous stream 20 may be removed overhead from the high pressure separator 18 while the liquid stream 22 may be withdrawn at the bottom of the high pressure separator 18.

The gaseous stream 20 may be scrubbed to remove hydrogen sulfide and ammonia (not shown) and further separated or recovered as fuel gas and utilized, as is known. The further processing of the gaseous stream 20 is not important for the understanding of the present invention.

The liquid stream 22 from the high pressure separator 18 is passed to a fractionation section 24. The fractionation section 24 is in downstream communication with the slurry hydrocracking reactor 10 for fractionating one or more product streams from the liquid stream 22 of slurry hydrocracked effluent stream 16. The fractionation section 24 may comprise one or several columns 26, 28, although it is shown only as two columns 26, 28, an atmospheric fractionation column 26 and a vacuum column 28.

The atmospheric fractionation column 26 produces one or more transportation fuel streams 30 and is operated typically with a temperature range of 75 to 420° C., preferably 135 to 360° C. and with an operating pressure of 138 to 551.6 kPag (20 to 80 psig), preferably between 206.8 to 482.6 kPag (30 to 70 psig). The transportation fuel stream 30 may be combined (as shown) and separated out in a further separation zone (not shown) or may comprise individual streams such as, for example, a naphtha product stream, a diesel product stream, a kerosene product stream, and the like. Other streams may also be separated. The atmospheric fractionation column 26 also provides a bottoms stream 32, or residue stream, which may comprise material with an initial boiling point above 340° C. (645° F.).

The bottoms stream 32 from the atmospheric fractionation column 26 is passed to the vacuum column 28 to be further separated into, for example, an LVGO stream 34, an HVGO stream 36, both preferably withdrawn from side outlets of the vacuum column 28. The HVGO stream 36 may be passed back to the slurry hydrocracking reactor 10, or it may be recycled back as the heavy product recycle stream 14 discussed above, or it may be recovered as a net HVGO product stream 35, or both. A vacuum column bottoms 38 (or pitch stream) can be recovered from a bottom of the vacuum column 28. The vacuum column 28 is preferably operated in a temperature range of 220 to 420° C., preferably 240 to 400° C., and with a pressure between 0.5 and 6.6 kPag.

The vacuum column bottoms 38 from the vacuum column 28 will be heavily aromatic and contain slurry hydrocracking catalyst. The hydrocarbon materials will typically have an initial boiling point at or above 524° C. (975° F.). Accordingly, to separate the vacuum column bottoms 38 into various portions, the vacuum column bottoms 38 may be passed to a deashing zone 40. As will described in more detail below, a portion of a drag stream from the slurry hydrocracking reactor 10 may be combined with the vacuum column bottoms 38.

In the deashing zone 40, the vacuum column bottoms 38 (which may be combined with a portion of a drag stream from the slurry hydrocracking reactor 10) will be mixed with a solvent in vessel 41 in the deashing zone 40. The solvent can be an internal solvent, i.e., a solvent produced within the refinery or process, such as clarified slurry oil, or the solvent can be an external solvent, such as toluene, or furfural, or a combination of the two. The type of solvent used may depend on the desired use of the deashed pitch, for example, as asphalt binder. The solvent and the soluble portions of the pitch will be separated from the insoluble portions of the pitch. The separated insoluble portions of the pitch may be dried to recover solvent (to be recycled with feed (the vacuum column bottoms 38, a portion of a drag stream from the slurry hydrocracking reactor 10, or a mixture of the two) to the deashing zone 40) and to provide a dried solids 42.

A mixture 44 of solvent and the soluble portions of the pitch can be passed to a vacuum column 46 to separate the solvent and the soluble portions of the pitch into a second HVGO stream 48 and a deashed pitch stream 50. The second HVGO stream 48 may be combined with the HVGO stream 36 from the vacuum column 28 in the fractionation section 24 and recycled to the slurry hydrocracking reactor 10 as heavy product. The deashed pitch 50 may be used as discussed above, for asphalt blending and/or as a binder for anodes.

Returning to the slurry hydrocracking reactor 10, eventually, the slurry in the slurry hydrocracking reactor 10 which comprises a mixture of catalyst, coke, converted hydrocarbons, and unconverted hydrocarbons is removed via a drag stream 52 from the slurry hydrocracking reactor 10 when the concentration of solids in the bottom of the reactor increases beyond a threshold value. Since the drag stream 52 will be heavy liquid materials, the drag stream 52 is taken from the bottom half or bottom third of the slurry hydrocracking reactor 10. Typically, as mentioned above, this slurry mixture from the drag stream 52 is intermittently removed and may be stored in a slop tank and eventually burned as a fuel in cement kilns, after the gases and light volatile materials have been removed.

However, this slurry mixture in the drag stream 52 may include naphtha, diesel and other distillate range materials. Additionally, the drag stream may also contain from 30 to 50 wt % VGO. In order to recover these desirable hydrocarbons, the drag stream 52 is passed to a separation zone 54.

The separation zone 54 preferably comprises one or more vessels 53 for separating or disengaging a vapor portion 56 of the slurry mixture from a liquid portion 58 of the slurry mixture. The vapor portion 56 will comprise one or more converted hydrocarbons such as naphtha, diesel, and other distillate range or lighter materials. The vapor portion 56 may be passed to the high pressure separator 18 for separation and recovery of the same along with products in the slurry hydrocracked effluent stream 16. The separator vessel 53 is operated at a temperature range of 375 to 425° C., and a pressure range of 13 to 27 MPa, or slightly above the pressure of the high pressure separator 18.

The liquid portion 58 will include VGO, as well as catalyst particles and materials with an initial boiling point at or above 524° C. (975° F.). The amount of VGO in the liquid portion 58 may be between 30 to 50 wt %. Accordingly, the VGO in the liquid portion 58 can be recovered from the vacuum column 46 in the deashing zone 40. Accordingly, the liquid portion 58 may be combined with the vacuum column bottoms 38 from the vacuum column 28 of the fractionation zone 24. Any VGO in the liquid portion 58 can be recovered with the HVGO stream 48 from the vacuum column 46 in the deashing zone 40, and, as discussed above, recycled back to the slurry hydrocracking reactor 10 for further conversion. The materials with an initial boiling point at or above 524° C. (975° F.) from the liquid portion 58 of the slurry material in the drag stream 52 will separate out as deashed pitch that can be used as discussed above. Any remaining catalyst or other solid particles from the liquid portion 58 of the slurry material in the drag stream 52 will be recovered along with the dried solids 42.

By recovering HVGO and deashed pitch in the liquid portion of the slurry materials, as well as lighter materials in the vapor portion of the drag stream, the recovery from the slurry hydrocracking unit has been increased. Additionally, less waste is generated by processing the liquid portion of the drag stream along with pitch from the vacuum columns bottoms, resulting in a higher overall feed conversion.

It should be appreciated and understood by those of ordinary skill in the art that various other components such as valves, pumps, filters, coolers, etc. were not shown in the drawings as it is believed that the specifics of same are well within the knowledge of those of ordinary skill in the art and a description of same is not necessary for practicing or understating the embodiments of the present invention.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A process for recovering hydrocarbons from a hydrocracking zone, the process comprising:

cracking a feed stock in a hydrocracking zone to produce a converted hydrocarbon stream, the hydrocracking zone comprising a slurry hydrocracker;

withdrawing an effluent stream from the slurry hydrocracker in the hydrocracking zone;

passing the effluent stream to a high pressure separator;

removing a drag stream taken from a bottom half of the slurry hydrocracker in the hydrocracking zone, the drag stream comprising a mixture of catalyst, coke, converted hydrocarbons, and unconverted hydrocarbons;

separating the drag stream into a vapor portion and a liquid portion, the vapor portion of the drag stream comprising converted hydrocarbons; and, separating HVGO from the liquid portion of the drag stream with a solvent in a deashing zone.

2. The process of claim 1 further comprising:

combining the vapor portion of the drag stream with the converted hydrocarbon stream to form a combined hydrocarbon stream.

3. The process of claim 2 wherein the vapor portion of the drag stream and the converted hydrocarbon stream are combined in a separation zone, and the process further comprising:

separating the combined hydrocarbon stream into a C4− hydrocarbon stream and a C5+ hydrocarbon stream.

4. The process of claim 3 further comprising:

separating the C5+ hydrocarbon stream into a transportation fuel stream and a residue stream.

5. The process of claim 4 further comprising:

passing the residue stream to a vacuum separation zone comprising at least one vacuum column; and, separating the residue stream into an LVGO stream, an HVGO stream and a pitch stream.

6. The process of claim 5 further comprising:

passing at least a portion of the HVGO stream from the vacuum separation zone to the hydrocracking zone; and, passing the HVGO stream separated from the liquid portion of the drag stream to the hydrocracking zone.

7. The process of claim 6 further comprising:

combining the at least a portion of the HVGO stream from the vacuum separation zone and the HVGO stream separated from the liquid portion of the drag stream for form a combined HVGO stream; and, passing the combined HVGO stream to the hydrocracking zone.

8. The process of claim 1 further comprising:

separating the liquid portion of the drag stream in the deashing zone into a dried solids, a deashed pitch, and the HVGO stream.

9. The process of claim 8 wherein the dried solids comprises an insoluble portion of the liquid portion of the drag stream.

10. The process of claim 9 further comprising:

passing a pitch from a bottoms stream of a vacuum column to the deashing zone.

11. The process of claim 10 wherein the pitch comprises a portion of the converted hydrocarbon stream from the hydrocracking zone.

12. A process for recovering hydrocarbons from a hydrocracking zone, the process comprising:

removing a drag stream taken from a bottom half of a slurry hydrocracker in a hydrocracking zone;

passing the drag stream to a first separation zone, the drag stream comprising a mixture of catalyst, coke, converted hydrocarbons, and unconverted hydrocarbons;

separating the drag stream in the first separation zone into a vapor portion and a liquid portion, the vapor portion of the drag stream comprising converted hydrocarbons;

separating the liquid portion of the drag stream in a second separation zone into an HVGO stream and a pitch stream;

withdrawing an effluent stream from the slurry hydrocracker in a hydrocracking zone; and passing the effluent stream to a third separation zone having a high pressure separator, the third separation zone being different from the first separation zone and the second separation zone.

13. The process of claim 12 wherein the pitch stream comprises a deashed pitch stream, and the process further comprising:

removing solids from the liquid portion of the drag stream in the second separation zone.

14. The process of claim 12 further comprising:

passing the vapor portion of the drag stream to the third separation zone.

15. The process of claim 14 further comprising:

separating the vapor portion of the drag stream in the third separation zone into a C4− hydrocarbon stream and a C5+ hydrocarbon stream.

16. The process of claim 15 further comprising:

separating the C5+ hydrocarbon stream into a transportation fuel stream and a residue stream.

17. The process of claim 16 further comprising:

passing the residue stream to a vacuum separation zone comprising at least one vacuum column; and, separating the residue stream into a LVGO stream, an HVGO stream and a pitch stream.

18. The process of claim 17 further comprising:

passing the pitch stream to the second separation zone;

combining the HVGO stream from the at least one vacuum column and the second separation zone to form a combined HVGO stream; and, passing the combined HVGO to the hydrocracking zone.

19. A process for recovering hydrocarbons from a hydrocracking zone, the process comprising:

removing a drag stream taken from a bottom half of a slurry hydrocracker;

separating the drag stream in a first separation zone into a vapor portion and a liquid portion, the drag stream comprising a mixture of catalyst, coke, converted hydrocarbons, and unconverted hydrocarbons, and wherein at least a portion of the vapor portion of the drag stream comprises converted hydrocarbons;

withdrawing an effluent stream from the slurry hydrocracker;

separating the vapor portion of the drag stream and a portion of an effluent stream from the slurry hydrocracker into a C4− hydrocarbon stream and a C5+ hydrocarbon stream, the effluent stream being different than the drag stream;

recycling a portion of the C5+ hydrocarbon stream back to the slurry hydrocracker;

deashing the liquid portion of the drag stream with a solvent in a deashing zone to provide a dried solids, a deashed pitch and an HVGO stream; and, recycling the HVGO stream back to the slurry hydrocracker.

* * * * *